United States Patent [19]

Ishino et al.

[11] 4,146,854

[45] Mar. 27, 1979

[54] HIGH FREQUENCY ATTENUATOR USING FERRITE BEADS

[75] Inventors: Ken Ishino, Nagareyama; Hiroshi Yamashita, Ichikawa; Masaaki Fukuda, Matsudo, all of Japan

[73] Assignee: TDK Electronics Co., Ltd., Tokyo, Japan

[21] Appl. No.: 823,713

[22] Filed: Aug. 11, 1977

[30] Foreign Application Priority Data

Aug. 19, 1976 [JP] Japan ..... 51-110975[U]

[51] Int. Cl.[2] ..... H01P 1/22

[52] U.S. Cl. ..... 333/81 R; 333/181

[58] Field of Search ..... 333/73 C, 79, 81 A, 333/81 R

[56] References Cited

U.S. PATENT DOCUMENTS

| | | | |
|---|---|---|---|
| 2,877,433 | 3/1959 | Devot | 333/73 C |
| 3,573,676 | 4/1971 | Mayer | 333/79 |
| 3,622,918 | 11/1971 | Ito et al. | 333/79 |
| 3,699,272 | 10/1972 | Fritz | 333/79 X |

*Primary Examiner*—Paul L. Gensler

*Attorney, Agent, or Firm*—Burgess, Ryan and Wayne

[57] ABSTRACT

An attenuator for use in filtering high-frequency waves propagated in a transmission line, comprising ferrite beads having a conductor passed therethrough which are enclosed firmly within a mixture having powder of ferrimagnetic material dispersed in an organic high polymer.

7 Claims, 4 Drawing Figures

HIGH FREQUENCY ATTENUATOR USING FERRITE BEADS

BACKGROUND OF THE INVENTION

The present invention relates to an attenuator for use in filtering high-frequency waves propagated in a transmission line of a direct current or a low-frequency alternating current.

An attenuator for filtering high-frequency waves propagated in a transmission line of a direct current of a low-frequency alternating current is known. The attenuator is used in connecting with the transmission line. In FIG. 1, there is shown an enlarged view of a portion of an attenuator which comprises ferrite beads (bead-shaped ferrite sintered bodies) $1_1$, $1_2$, $1_3$ - - - $1_n$ (n is an integer of from 20 to 500) having a conductor 2 passed through the same. The ferrite is a compound having the general formula of $MFe_2O_4$, wherein M is a bivalent metal such as Mn, Ni, Co, Mg, Cu, Zn and Cd. In such an attenuator, the high attenuation (more than 50 dB) can be obtained in the frequency range of about 500 kHz to about 5 GHz, but the attenuation is low in fequencies of higher than 5 GHz.

There is, in the prior art, another attenuator devised by the same inventors as those of the present invention. In FIG. 2, there is shown an enlarged view of a portion of the attenuator which comprises a conductor 2 which is enclosed firmly within a mixture 3 comprising a powder of ferrimagnetic material dispersed in an organic high polymer. The ferrimagnetic material may be ferrite powder, and the organic high polymer may be synthetic rubber. In such attenuator, the high attenuation (more than 50 dB) can be obtained in the frequency range of about 50 MHz to about 50 GHz, but the attenuation is low in frequencies of lower than 50 MHz.

By the present invention, there is provided an attenuator which can give high attenuation of more than 50 dB in the wide frequency range of from about 500 kHz to about 50 GHz.

SUMMARY OF THE INVENTION

The attenuator of the present invention comprises ferrite beads having a conductor passed therethrough which are enclosed firmly within a mixture having powdered ferrimagnetic material dispersed in an organic high polymer.

DESCRIPTION OF THE PREFERRED EMBODIMENT

Figure 1:
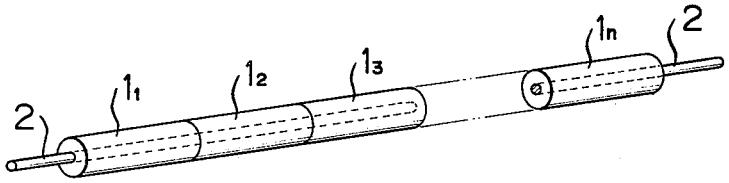
FIG. 1 (PRIOR ART)
FIG. 1 is a perspective view, on an enlarged scale, of a portion of a prior art attenuator.
Figure 2:
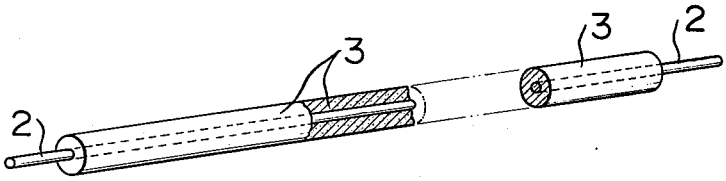
FIG. 2 (PRIOR ART)
FIG. 2 is a perspective view, on an enlarged scale, of a portion of another prior art attenuator, partially in section for illustrative clarity.
Figure 3:
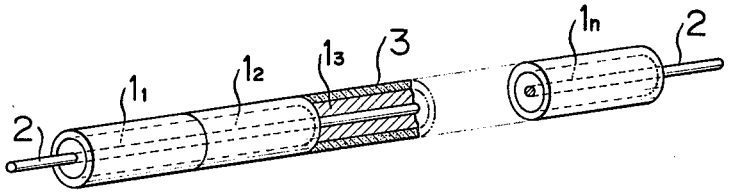
FIG. 3 is a perspective view, on an enlarged scale, of a portion of the attenuator of the present invention, partially in section for illustrative clarity.

On referring to FIG. 3 showing an enlarged view of a portion of the attenuator, a conductor 2 is passed through ferrite beads $1_1$, $1_2$, $1_3$ - - - $1_n$ which are embedded in a mixture 3 of ferrimagnetic powder and an organic high polymer.

The ferrite bead is a bead-shaped ferrite sintered body, for example, having a diameter of about 2 mm, a length of about 10 mm and a perforate hole of about 0.8 mm diameter.

The ferrite is a compound having the general formula $MFe_2O_4$ in which M is a bivalent metal such as Mn, Ni, Co, Mg, Cu, Zn and Cd.

Said powder of ferrimagnetic material is ferrite powder or iron powder or a mixture thereof.

The ferrite powder can be prepared as shown below.

The iron powder is obtained by decomposition of iron carbonyl such as $Fe(CO)_5$, $Fe_2(CO)_9$ or $Fe_3(CO)_{12}$.

The organic high polymers are preferably synthetic rubber such as fluorine-containing rubber, rubber chloride, silicone rubber, butyl rubber, polyisoprene, polybutadiene, chloroprene-copolymer and chlorosulfonated polyethylene. Sythetic resins such as epoxy resin, silicone resin, alkyd resin, urea resin, phenol resin, melamine resin, acrylic resin, polyvinylchloride, polyvinylacetate, unsaturated polyester resin, phthalic resin, polyamide, polyimide, polyurethane and polystyrene may be used in the present invention.

The organic high polymers are used as a binder of the ferrimagnetic powders.

The mixture of ferrimagnetic powder and organic high polymer can be prepared by mixing the following ingredients by means of a calender.

| | Parts by weight |
|---|---|
| Ferrimagnetic powder (ferrite powder or iron powder) Having a particle size of 1 ~ 20μ | 1 ~ 7 |
| Organic high polymer | 1 |

A preferred embodiment of the present invention will be shown below:

Mn - Zn - Ferrite powder was prepared as follows:

$Fe_2O_3$(71 g), 24 g of $MnO_2$ and 9 g of ZnO were each weighed out. The $Fe_2O_3$, $MnO_2$ and ZnO were mixed in a ball mill for 20 hours. The mixture was dried and then heated at a temperature of 1200° C. for one hour. The heated mixture was cooled and pulverized by an atomizer to obtain a ferrite powder having a particle size of 1 to 10μ.

The mixture was prepared by mixing the following ingredients:

| | |
|---|---|
| Ferrite powder (prepared as shown above) | 5 kg |
| Chloroprene-copolymer | 1 kg |

Ferrite beads were prepared as follows:

$Fe_2O_3$ (71 g), 24 g of $MnO_2$ and 9 g of ZnO were each weighed out. The $Fe_2O_3$, $MnO_2$ and ZnO were mixed in a ball mill for 20 hours. The mixture was dried and then pre-heated at a temperature of 800° C. for about3 hours and then cooled. The mixture was pulverized by an atomizer to obtain a powder having a particle size of less than 20μ. The powder was formed by compression molding of about 1 ton/cm$^2$ to obtain a shaped body having a size of 2.4 mm in diameter × 12 mm long having a perforate hole of 1 mm in diameter. The shaped body was heated at a temperature between about 1200° C. for 3 hours and then cooled to obtain the desired ferrite beads.

As a conductor, a copper wire having a thickness of 0.5 mm was used.

Figure 4:
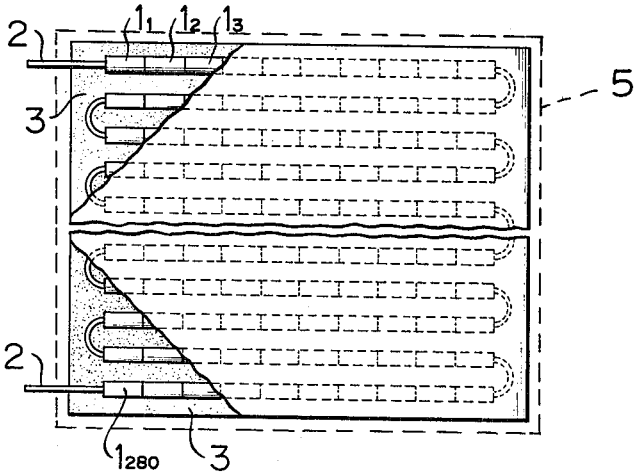
FIG. 4 is a plan view of the attenuator of the present invention, partially broken away for illustrative clarity.

Referring to FIG. 4, the conductor 2 was passed through 280 pieces of ferrite beads $1_1$, $1_2$, $1_3$ - - - $1_{280}$ prepared as shown above, and then convolutely arranged and embedded in the mixture 3 having ferrite powder dispersed in chloroprene-copolymer to obtain an attenuator of the present invention. Said mixture is in the form of a plate having a size of 10 cm × 15 cm and a thickness of 2.5 mm.

An attenuator of higher than 50 dB was obtained in the frequency range of from 500 kHz to 50 GHz by using the attenuator as prepared above.

The attenuator in the form of a plate as prepared above can more effectively be used by putting it in a metallic case 5 such as a copper case or aluminum case.

We claim:

1. An attenuator for high-frequency waves, comprising:

a plurality of adjacent rows of ferrite beads, said rows being in mutual juxtaposition and generally coplanar, the beads of each row each having a hole therethrough, with the holes in longitudinal alignment;

a conductor extending through all of said holes and passing successively through said rows between an input and an output terminal; and a mixture of powdered ferrimagnetic material dispersed in an organic high polymer binder surrounding said ferrite beads and conductor and forming a plate in which said beads and conductor are embedded.

2. An attenuator according to claim 1 wherein each said ferrite bead is a bead-shaped ferrite sintered body, said ferrite being a compound having the general formula $MFe_2O_4$ in which M is Mn, Ni, Co, Mg, Cu, Zn and Cd.

3. An attenuator according to claim 1 wherein said powdered ferrimagnetic material is selected from the group consisting of ferrite powder, iron powder and a mixture of ferrite powder and iron powder, said ferrite being a compound having the general formula $MFe_2O_4$ in which M is Mn, Ni, Co, Mg, Cu, Zn and Cd.

4. An attenuator according to claim 1 wherein said organic high polymer is a synthetic rubber selected from the group consisting of fluorine-containing rubber, rubber chloride, silicone rubber, butyl rubber, polyisoprene, polybutadiene, chloroprene-copolymer and chlorosulfonated polyethylene.

5. An attenuator according to claim 1 wherein said organic high polymer is a synthetic resin selected from the group consisting of epoxy resin, silicone resin, alkyd resin, urea resin, phenol resin, melamine resin, acrylic resin, polyvinylchloride, polyvinylacetate, unsaturated polyester resin, phthalic resin, polyamide, polyimide, polyurethane and polystyrene.

6. An attenuator according to claim 1 wherein said mixture comprises 1 to 7 parts by weight of a powder of a ferrimagnetic material and 1 part by weight of an organic high polymer.

7. The attenuator according to claim 1, further comprising a metallic conductive case surrounding said plate.

* * * * *